US010155388B2

(12) United States Patent
Imahashi et al.

(10) Patent No.: US 10,155,388 B2
(45) Date of Patent: Dec. 18, 2018

(54) MIST COLLECTION APPARATUS AND LIQUID EJECTION APPARATUS

(71) Applicant: CANON KABUSHIKI KAISHA, Tokyo (JP)

(72) Inventors: Yusuke Imahashi, Kawasaki (JP); Masahiko Kubota, Tokyo (JP); Hiroshi Arimizu, Kawasaki (JP); Nobuhito Yamaguchi, Inagi (JP); Arihito Miyakoshi, Tokyo (JP); Yoshinori Itoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/415,027

(22) Filed: Jan. 25, 2017

(65) Prior Publication Data

US 2017/0217192 A1 Aug. 3, 2017

(30) Foreign Application Priority Data

Feb. 1, 2016 (JP) ..... 2016-017080

(51) Int. Cl.
*B41J 2/165* (2006.01)
*B41J 2/17* (2006.01)
*B41J 2/185* (2006.01)

(52) U.S. Cl.
CPC ..... *B41J 2/16523* (2013.01); *B41J 2/16585* (2013.01); *B41J 2/1714* (2013.01); *B41J 2/185* (2013.01); *B41J 2002/1853* (2013.01)

(58) Field of Classification Search
CPC ..... B41J 2/16585; B41J 2/1714; B41J 2/185; B41J 2002/1853
See application file for complete search history.

(56) References Cited

U.S. PATENT DOCUMENTS

| | | | | |
|---|---|---|---|---|
| 9,199,472 | B2 | 12/2015 | Ishida et al. | |
| 9,358,793 | B2 | 6/2016 | Arimizu et al. | |
| 9,381,746 | B2 | 7/2016 | Miyakoshi et al. | |
| 9,498,962 | B2 | 11/2016 | Ishida et al. | |
| 2010/0188469 | A1* | 7/2010 | Ikegami | B41J 3/543 347/102 |
| 2016/0271950 | A1 | 9/2016 | Imahashi et al. | |
| 2016/0271952 | A1 | 9/2016 | Arimizu et al. | |
| 2017/0225497 | A1* | 8/2017 | Sekimoto | B41J 2/165 |

FOREIGN PATENT DOCUMENTS

| | | | |
|---|---|---|---|
| JP | 2004306270 | A | * 11/2004 |
| JP | 2015-083372 | A | 4/2015 |

* cited by examiner

*Primary Examiner* — Kristal Feggins
*Assistant Examiner* — Kendrick Liu
(74) *Attorney, Agent, or Firm* — Venable LLP

(57) ABSTRACT

A blowout port for gas is efficiently configured without impairing mist collection performance. Two blowout ports for gas are adjacent to each other by interposing a partition. An end of the partition is provided at a position near a deep side of the two blowout ports relative to ends of the two blowout ports so as to form a step.

7 Claims, 14 Drawing Sheets

MIST COLLECTION APPARATUS AND LIQUID EJECTION APPARATUS

BACKGROUND OF THE INVENTION

Field of the Invention

The present invention relates to a technique for collecting mist resulting from ejection of a liquid from a liquid ejection head.

Description of the Related Art

In an ink jet printing apparatus (liquid ejection apparatus), a fine mist of ink that floats instead of landing on a sheet may be generated and adhere to various positions inside the apparatus. For example, in a case where the mist adheres to a print head and grows, the ink may be inappropriately ejected. In a case where the mist adheres to a sheet conveying mechanism and grows, the sheet may be contaminated.

Japanese Patent Laid-Open No. 2015-083372 describes a configuration including a blowout port and a suction port for gas both located near the print head to allow mist to be sucked through the suction port along with gas blown out through the blowout port, thus allowing the mist to be collected before attaching to the interior of the apparatus.

In the apparatus in Japanese Patent Laid-Open No. 2015-083372, in a case where the print head has an increased length in association with a large print width, the blowout port for gas extending along the print head also has an increased length. However, it is not easy to accurately form the blowout port extending over a long distance like a slit.

SUMMARY OF THE INVENTION

The present invention provides a mist collection apparatus and a liquid ejection apparatus that need only low costs while delivering high mist collection performance.

In the first aspect of the present invention, there is provided a mist collection apparatus configured to collect mist generated from a head that ejects liquid, the mist collection apparatus comprising:

- a blowout port provided in a vicinity of the head and configured to blow out gas, and a suction port provided in a vicinity of the head and configured to suck the gas including the mist, wherein
- the blowout port includes a first outlet and a second outlet extending lineally along a predetermined direction, and
- a partition is provided between the first outlet and the second outlet in the predetermined direction at a position withdrawn from outlet ends of the first outlet and the second outlet in a direction of gas blowout.

In the second aspect of the present invention, there is provided a liquid ejection apparatus comprising:

- a head that ejects liquid to a medium, and
- a mist collection apparatus configured to collect mist generated from the head,
- wherein the mist collection apparatus comprises a blowout port configured to blow out gas to the medium, and a suction port configured to suck the gas including the mist,
- wherein the blowout port includes a first outlet and a second outlet extending lineally along a predetermined direction, and a partition is provided between the first outlet and the second outlet in the predetermined direction at a position withdrawn from outlet ends of the first outlet and the second outlet in a direction of gas blowout.

According to the present invention, in spite of a long head, a low-cost apparatus is provided by dividing the blowout port into a plurality of pieces that are coupled together. In this case, flows of gas blown out through the adjacent blowout port pieces are likely to join each other. Thus, high mist collection performance is delivered even at coupling portion in which the blowout port pieces are coupled together.

Further features of the present invention will become apparent from the following description of exemplary embodiments (with reference to the attached drawings).

DESCRIPTION OF THE EMBODIMENTS

Embodiments of the present invention will be described based on the drawings.

(First Embodiment)

Figure 14:
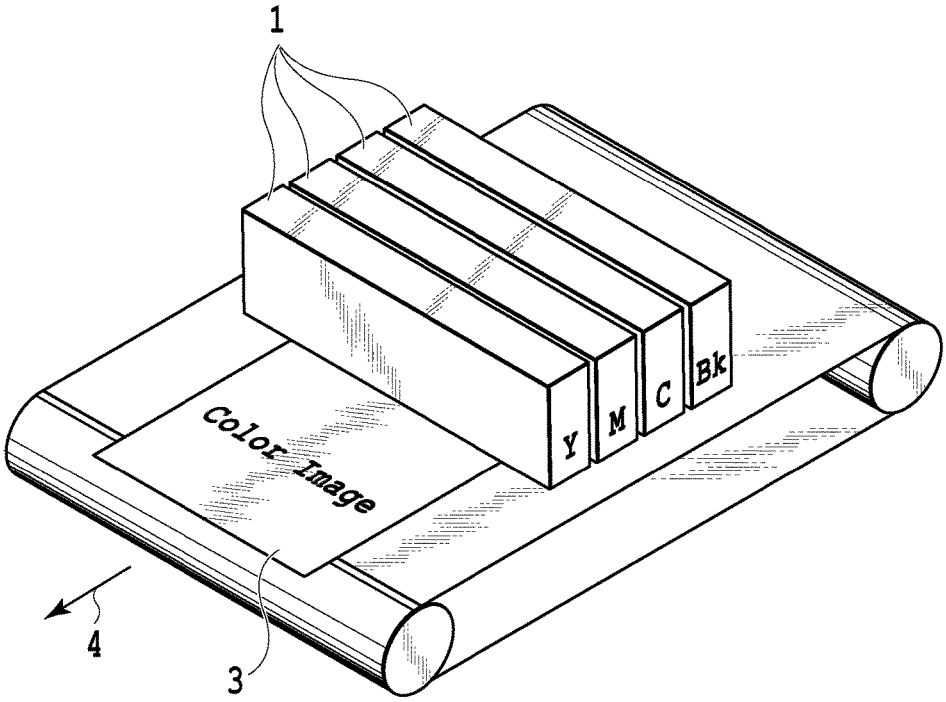
FIG. 14 is a schematic perspective view of a full-line print apparatus.

FIG. 14 is a schematic diagram of an ink jet print apparatus that is an example of a liquid ejection apparatus to which the present invention is applied. The ink jet print apparatus in the present example is of a type that performs line printing. For color printing, the ink jet print apparatus includes four ink jet print heads (liquid ejection heads) 1 that can eject inks in black (Bk), cyan (C), magenta (M), and yellow (Y), respectively. Each of the print heads 1 is a long line head having a length covering a sheet width used. A sheet 3 that is a print medium is conveyed in a direction of arrow 4 (conveying direction) by a conveying mechanism 40 using a conveying belt, a conveying roller, or the like. Each of the print heads 1 is provided with a plurality of ejection ports through which ink can be ejected. The ejection ports form an ejection port array by being arranged in a predetermined direction (arranging direction) that intersects (in the present example, is orthogonal to) the conveying direction 4 (moving direction) in which the sheet is conveyed. To eject ink through the ejection port, ejection energy generation element such as electrothermal transducing element (heater) or a piezoelectric element can be used. Such a full-line print apparatus consecutively prints an image on the sheet 3 using a line print method by ejecting the ink through the ejection ports based on print data while consecutively conveying the sheets 3 in the conveying direction 4. At this time, besides ink droplets that land on the sheet 3 to print an image thereon, fine ink droplets (mist) are generated which float between the sheet 3 and the print heads 1 without landing on the sheet 3.

Figure 1:
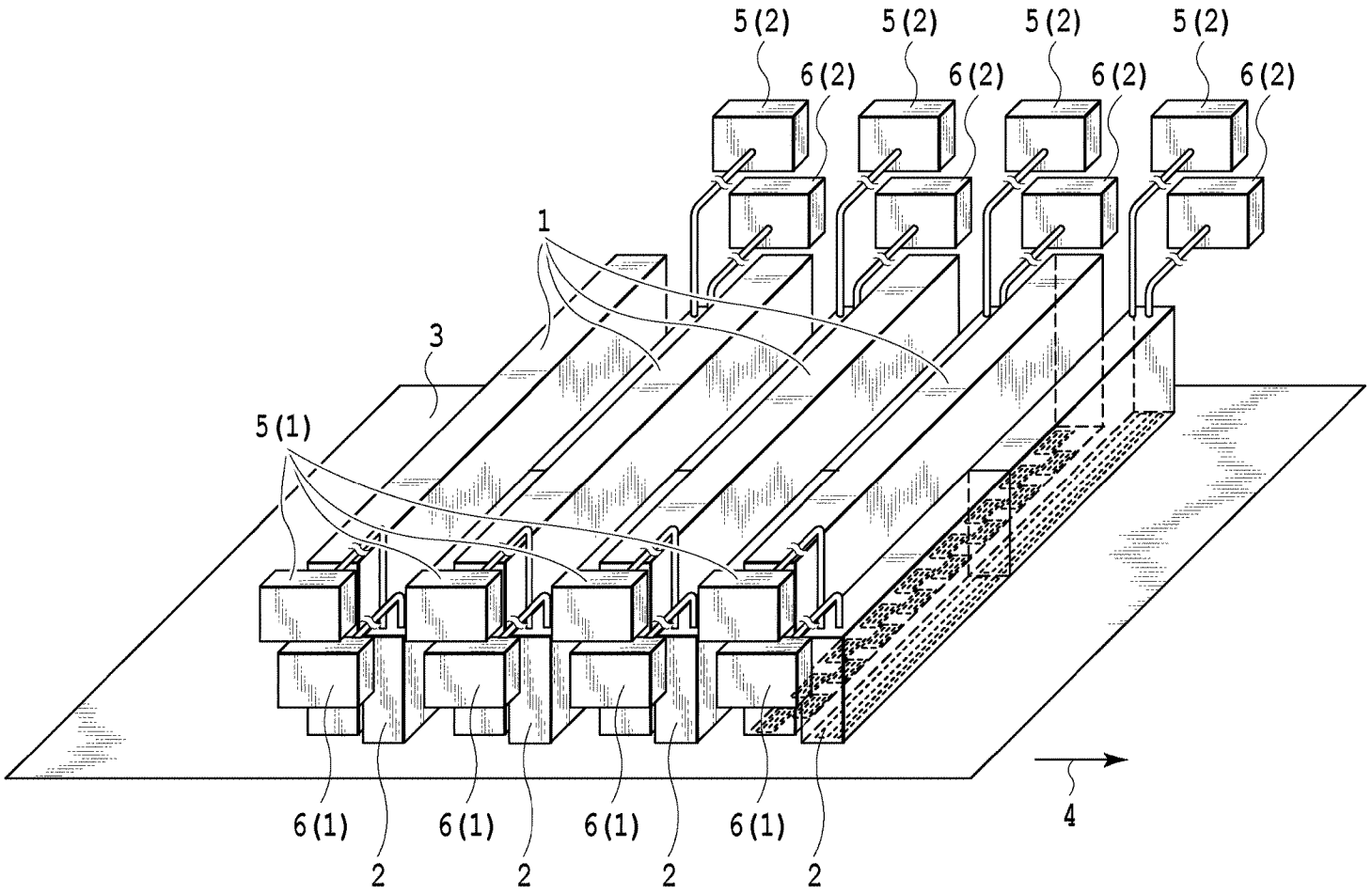
FIG. 1 is a perspective view of a mist collection apparatus in a first embodiment of the present invention.

FIG. 1 is a perspective view of an important part of the ink jet print apparatus equipped with the four print heads 1 and four mist collection components 2 corresponding to the print heads 1.

As depicted in FIG. 1, the print heads 1 and the mist collection components 2 are alternately arranged along the conveying direction 4 of the sheet 3. The mist collection components 2 are configured to collect a mist of ink failing to land on the sheet 3, and extend in a direction that intersects (in the present example, is orthogonal to) the conveying direction 4 similarly to the print heads 1. Relative movement between the print heads 1 and the sheet 3 causes an air current flowing in the conveying direction 4 to be generated between the sheet 3 and the print heads 1. This results in migration of mist ejected through the ejection port array and failing to land on the sheet 3. The mist emitted from the print head 1 is migrated, by the air current generated between the print head 1 and the sheet 3, toward the corresponding mist collection component 2 positioned downstream of the print head 1 in the conveying direction 4. A suction apparatus 5(1) and a gas supplying apparatus 6(1) are connected to one of longitudinally opposite sides of each of the mist collection components 2. A suction apparatus 5(2) and a gas supplying apparatus 6(2) are connected to the other side of the mist collection component 2.

Figure 2:
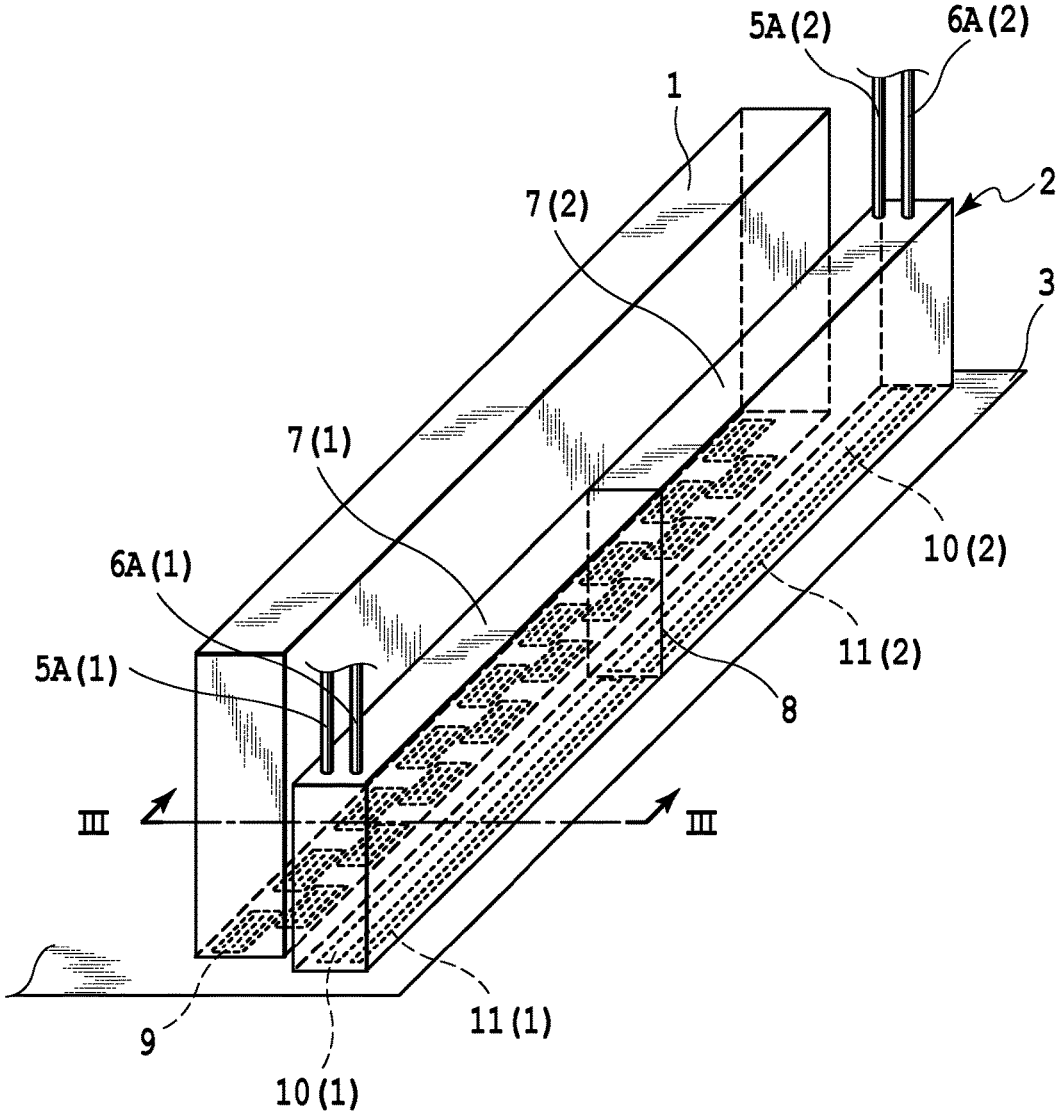
FIG. 2 is a perspective view of a mist collection component in FIG. 1.

FIG. 2 is a schematic perspective view of a combination portion in which the print head 1 is combined with the mist collection component 2 positioned downstream of the print head 1 in the conveying direction 4. In the print head 1 in the present example, chips on which a plurality of ejection port arrays 9 is formed are arranged in a staggered manner. Gas fed from the gas supplying apparatuses 6(1) and 6(2) is first introduced into the corresponding mist collection component 2 through introduction pipes 6A(1) and 6A(2) and then blown out toward the sheet 3 through a first and a second blowout ports (a first and a second outlets) 11(1) and 11(2). The type of the gas is optional, and may be, for example, air or inert gas. The gas blown out toward the sheet 3 is bounced by a surface of the sheet 3 and then sucked by the suction apparatuses 5(1) and 5 (2) through first and a second suction ports (a first and a second inlets) 10(1) and 10 (2), the interior of the mist collection component 2, and suction pipes 5A (1) and 5A (2). The gas sucked into the suction ports 10 (1) and 10 (2) contains the mist of ink. Therefore, the mist of ink is sucked and collected by the suction apparatuses 5(1) and 5(2) along with the gas.

Figure 3A:
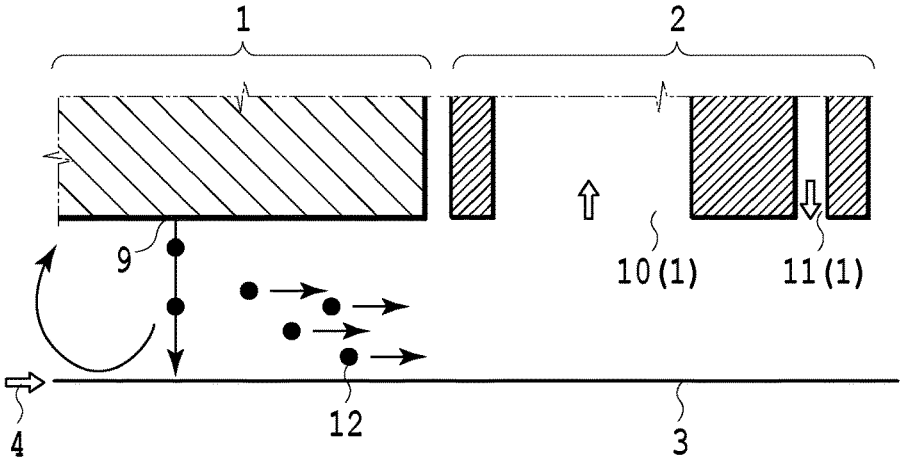
FIG. 3A, FIG. 3B, and FIG. 3C are enlarged sectional views taken along line III-III in FIG. 2 and illustrating a mist collection mechanism.
Figure 3B:
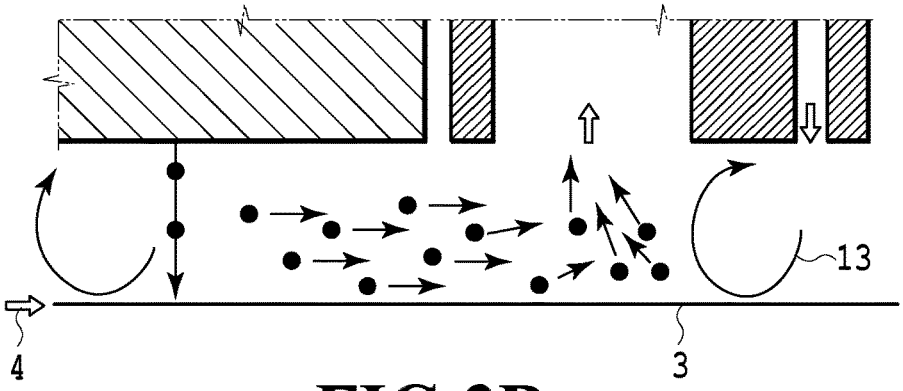
Figure 3C:
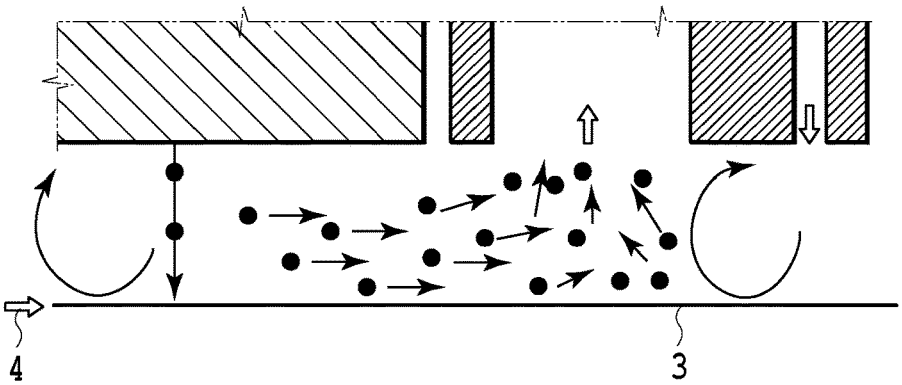

FIG. 3A, FIG. 3B, and FIG. 3C are sectional views taken along line III-III in FIG. 2. As depicted in FIG. 3A, in the mist collection component 2, the suction port 10 (1) is positioned upstream of the sheet 3 in the conveying direction 4, and the blowout port 11(1) is positioned downstream of the suction port 10 (1). Therefore, the ejection ports, the suction port 10 (1), and the blowout port 11 (1) are positioned in this order toward the downstream side in the moving direction of the sheet 3 with respect to the print head 1. The positional relation between the suction port 10(2) and the blowout port 11 (2) and the functions of the ports 10 (2) and 11 (2) are similar to the positional relation between the suction port 10 (1) and the blowout port 11 (1) and the functions of the ports 10 (1) and 11 (1). The mist 12 of ink failing to land on the sheet 3 migrates toward the downstream side in the conveying direction 4 along with an air current resulting from movement of the sheet 3 in the conveying direction 4 as depicted in FIG. 3A. The mist 12 is raised above the sheet 3 by the gas blown out through the blowout port 11(1) in the mist collection component 2 as depicted in FIG. 3B, and is then sucked through the suction port 10(1) as depicted in FIG. 3C. Consequently, the mist 12 can be collected while being restrained from migrating toward the downstream side in the conveying direction 4.

Figure 4A:
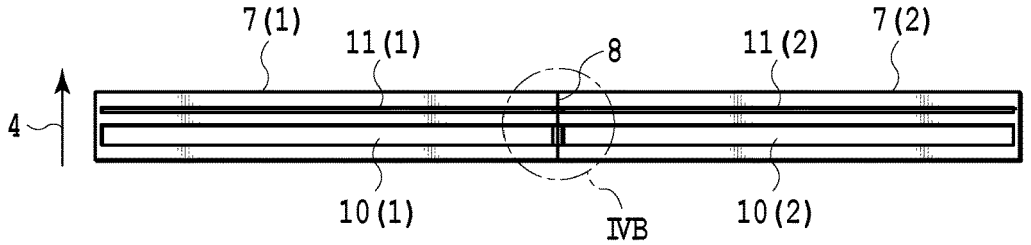
FIG. 4A is a bottom view of the mist collection component in FIG. 1.
Figure 4B:
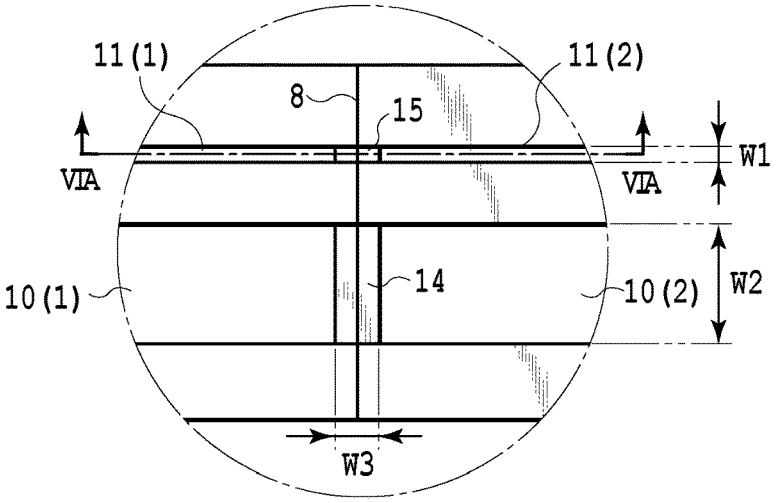
FIG. 4B is an enlarged view of an IVB circle portion.
Figure 4C:
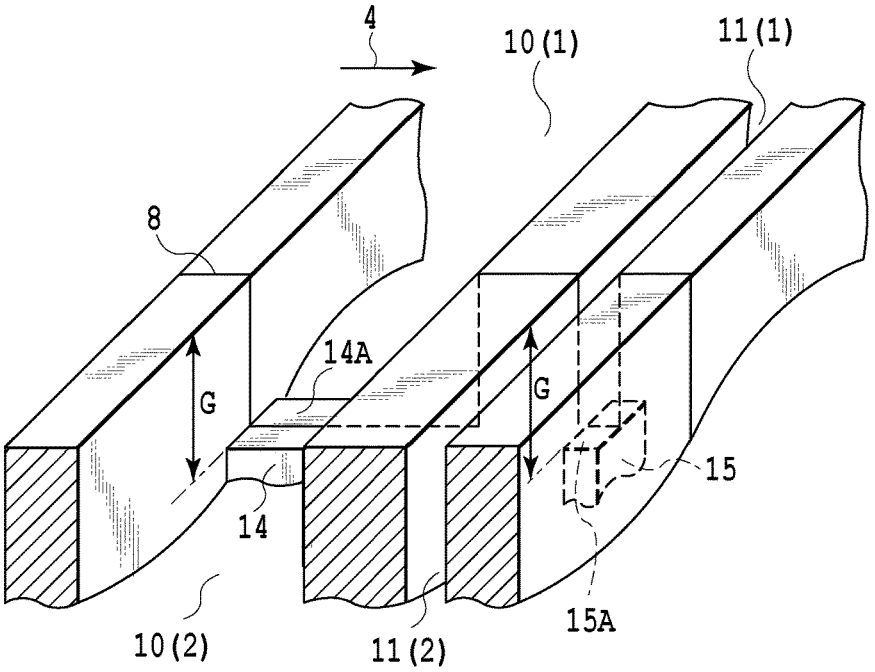
FIG. 4C is an enlarged perspective view of the mist collection component in FIG. 1.

FIG. 4A is a bottom view of the mist collection component 2 as viewed from the sheet 3 side, FIG. 4B is an enlarged view of an IVB circle portion in FIG. 4A, and FIG. 4C is a perspective view of the mist collection component as seen from a sheet surface.

The mist collection component 2 in the present embodiment is configured such that two mist collection units 7 (1) and 7 (2) each with a width of 10 inches are coupled together so as to extend in the direction of the ejection port array as depicted in FIG. 4A. In the units 7(1) and 7(2) that can be coupled together, the blowout ports 11 (1) and 11 (2) are shaped like slits each with a uniform width of 0.5 mm and extending in the predetermined direction, and the suction ports 10 (1) and 10(2) are shaped like slits each with a uniform width of 3.0 mm and extending in the predetermined direction. In the predetermined direction (longitudinal direction), all of the blowout ports and the suction ports are shaped to have a uniform width except for ends of each port.

The units 7(1) and 7(2) are coupled together at a coupling portion 8 such that the blowout ports 11 (1) and 11 (2) are aligned in a straight line and that the suction ports 10 (1) and 10 (2) are aligned in a straight line. A wall-like partition 14 located opposite to the sheet 3 is interposed between the suction ports 10(1) and 10(2), and a partition 15 serving as an opposite portion opposite to the sheet 3 is provided between the suction ports 11 (1) and 11 (2). Each of the partitions 14 and 15 has a thickness (width) W3 of 1 mm. A 2-mm step G is formed between an end 14A (a tip) of the partition 14 and an inlet end portion (opening tip) of the suction ports 10 (1) and 10 (2) that is closest to the sheet. In other words, the position of the end 14A of the partition 14, which is an area located opposite to the sheet, is withdrawn 2 mm from the inlet end portion of the suction ports 10 (1) and 10 (2) toward the inside (downward in FIG. 4C) of the suction ports 10 (1) and 10 (2). The inlet ends of the suction ports 10 (1) and 10 (2) lie continuously with each other at the same height above the end 14A of the partition 14 to form a rectangular frame. The partition 14 forms a recessed portion with a step in an area where the suction ports 10 (1)

and 10 (2) are coupled together. Likewise, a 2-mm step G is formed between an end 15A of the partition 15 and an outlet end portion (opening tip) of the blowout ports 11 (1) and 11 (2). In other words, the position of the end 15A of the partition 15 is withdrawn and set inward (downward in FIG. 4C) from the outlet end of each of the blowout ports 11 (1) and 11 (2). The outlet ends of the blowout ports 11(1) and 11(2) lie continuously with each other at the same height above the end 15A of the partition 15. The partition 15 forms a recessed portion with a step in an area where the blowout ports 11(1) and 11(2) are coupled together.

Figure 5A:
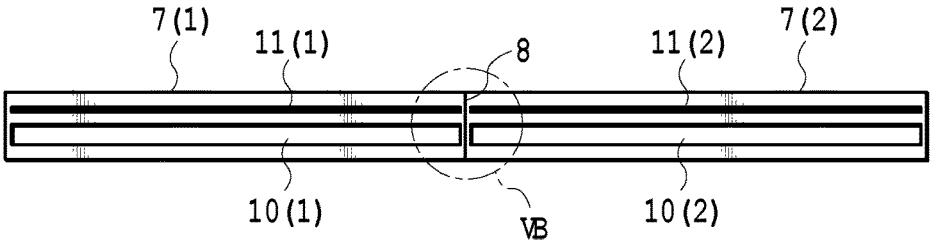
FIG. 5A is a bottom view of a mist collection component in a comparative example.
Figure 5B:
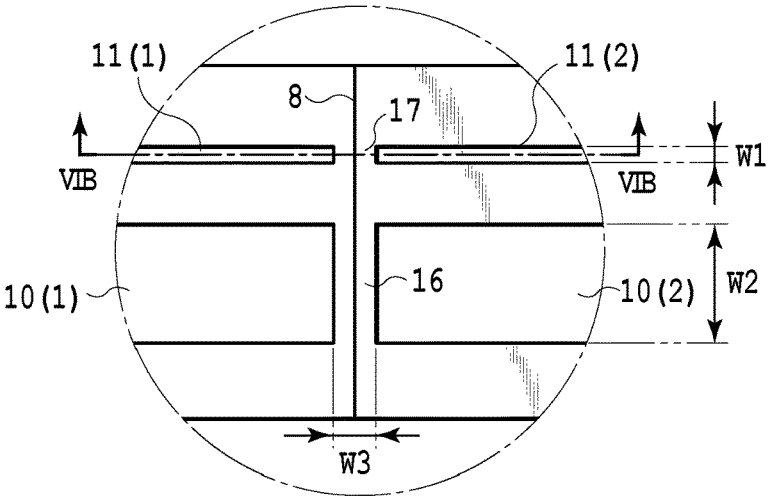
FIG. 5B is an enlarged view of a VB circle portion in FIG. 5A.
Figure 5C:
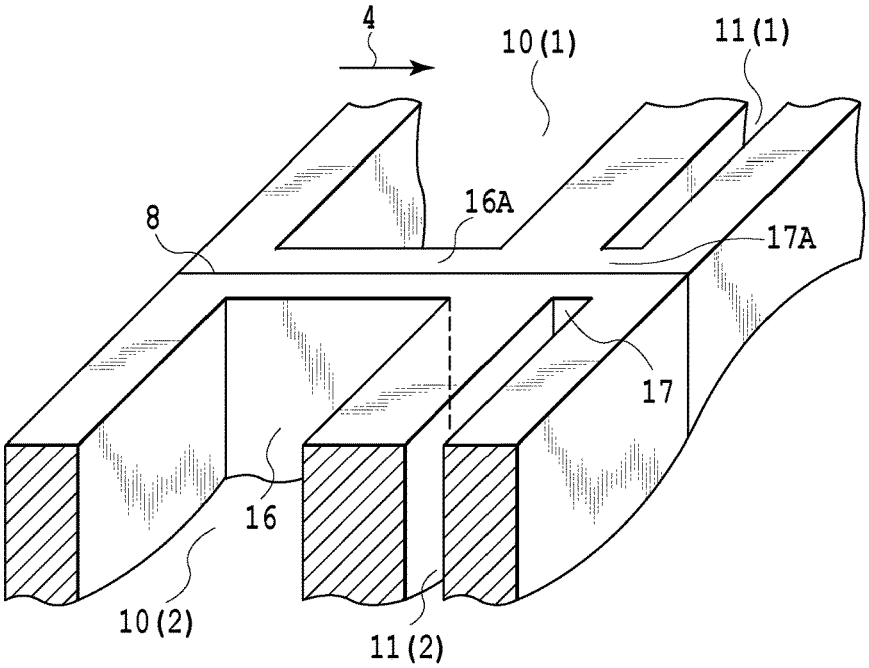
FIG. 5C is an enlarged perspective view of the mist collection component in the comparative example.

FIG. 5A, FIG. 5B, and FIG. 5C are diagrams illustrating the mist collection component in a comparative example. In the comparative example, partitions 16 and 17 are provided instead of the partitions 14 and 15 in FIGS. 4B and 4C. No step is formed between an end 17A of the partition 17 and an outlet end portion of the blowout ports 11 (1) and 11 (2); the end 17A and the outlet end portion are at the same height. Likewise, no step is formed between an end 16A of the partition 16 and an inlet end portion of the suction ports 10 (1) and 10 (2) ; the end 16A and the inlet end portion are at the same height. In this regard, the mist collection component in FIG. 5A, FIG. 5B, and FIG. 5C is different from the mist collection component in FIG. 4A, FIG. 4B, and FIG. 4C.

A collection rate for a mist of ink is simulated for the mist collection component in the present embodiment in FIG. 4A, FIG. 4B, and FIG. 4C, which is referred to as the mist collection component A, and the mist collection component in the comparative example in FIG. 5A, FIG. 5B, and FIG. 5C, which is referred to as the mist collection component B. That is, each of the mist collection components A and B is mounted in the print apparatus as depicted in FIG. 1, and the collection rate for mist resulting from printing of images under the same conditions is estimated by simulation. The results of the simulation are indicated in Table 1 below. The mist collection rate achieved by the mist collection component A is 95%, indicating that substantially all of the mist can be collected. On the other hand, the mist collection rate achieved by the mist collection component B is 30%, indicating that sufficient collection of mist is precluded. (Table 1)

TABLE 1

Simulation results for first embodiment

| Mist collection component | Step (G) | Mist collection rate | Air current below coupling portion (8) |
|---|---|---|---|
| A | Step formed | 95% | Arrives on sheet |
| B | No step formed | 30% | Fails to arrive on sheet |

Figure 6B:
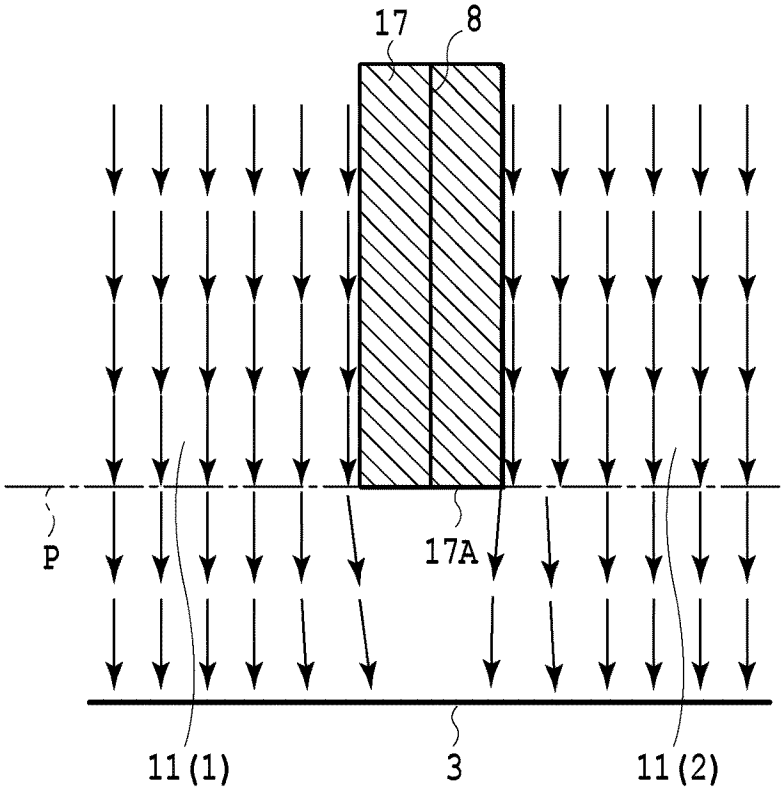
FIG. 6B is a sectional view of the blowout port taken along line VIB-VIB in FIG. 5B and illustrating gas velocity vectors.
Figure 6A:
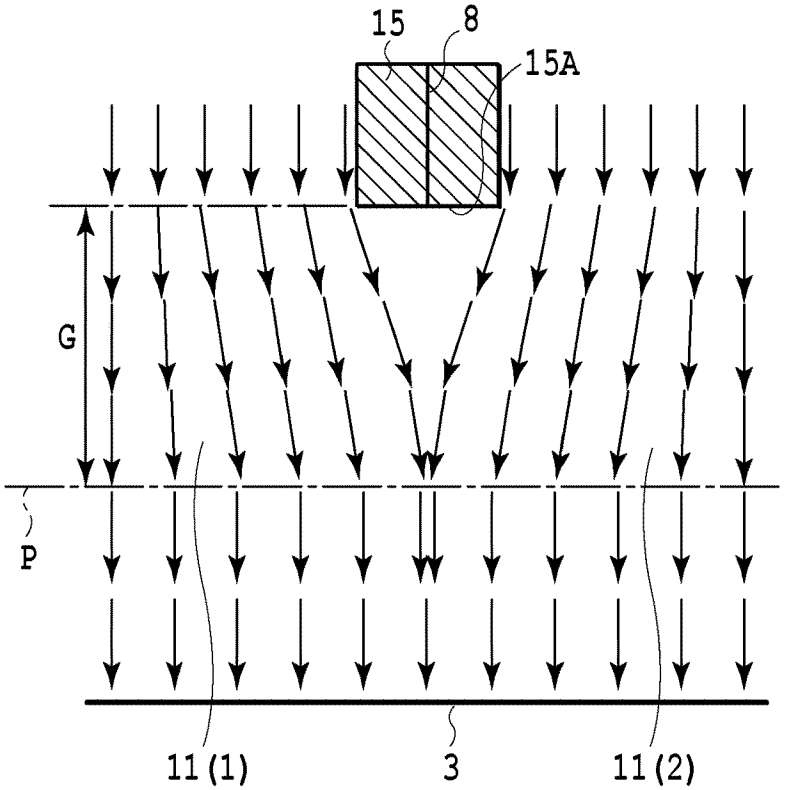
FIG. 6A is a sectional view of a blowout port taken along line VIA-VIA in FIG. 4B and illustrating gas velocity vectors.

FIG. 6A and FIG. 6B are diagrams for detailed analysis of the results. FIG. 6A is a diagram representing gas velocity vectors in a section of the blowout ports in the mist collection component A taken along line VIA-VIA in FIG. 4B. Likewise, FIG. 6B is a diagram representing gas velocity vectors in a section of the blowout ports in the mist collection component B taken along line VIB-VIB in FIG. 5B. As described above, the step G is formed between the end 15A of the partition 15 in FIG. 6A and the outlet end portion P of the blowout ports, whereas the step G is not formed between the end 17A of the partition 17 in FIG. 6B and the outlet end portion P of the blowout ports.

As depicted in FIG. 6A, in the mist collection component A, gas blown out through the blowout ports arrives on the sheet 3, located below the coupling portion 8. On the other hand, in the mist collection component B, the gas blown out through the blowout ports fails to arrive on the sheet 3, located below the coupling portion 8. In the present embodiment, as described above, the mist is raised from above the sheet by the gas blown out through the blowout ports, thus efficiently collecting the mist through the mist collection component. Therefore, a difference in mist collection rate between the mist collection components A and B is expected to depend on whether or not the gas blown out through the blowout ports arrives on the sheet 3, located below the coupling portion 8.

That is, in the mist collection component B, the end 17A of the partition 17 extends to the outlet end portion P of the blowout ports 11(1) and 11(2), and the blowout ports are separated from each other via the partition 17 over a range from the end 17A to the outlet end portion P. Thus, flows of the gas blown out through the blowout ports 11(1) and 11(2) are regulated by the partition 17 extending to the position P and prevented from arriving on the sheet 3, located below the coupling portion 8. As a result, sufficient collection of mist is precluded, and the mist flows toward the downstream side in the conveying direction 4. On the other hand, in the mist collection component A, the end 15A of the partition 15 does not extend to the outlet end portion P of the blowout ports 11(1) and 11(2), and the step G is formed between the end 15A and the outlet end portion P. Thus, the flows of the gas blown out through the blowout ports 11(1) and 11(2) join together in a space below the coupling portion 8 and arrive on the sheet 3, located below the coupling portion 8, as depicted in FIG. 6A. As a result, the gas is likely to arrive at any positions on the sheet 3, allowing the mist to be reliably collected from all the areas including the neighborhood of the coupling portion.

In the mist collection component B, the step G is not formed between the end 16A of the partition 16 and the inlet end portion of the suction ports 10(1) and 10(2). Thus, the mist having migrated to the inlet end portion of the suction ports is likely to impact the end 16A of the partition 16. Thus, the mist may adhere to the end 16A and then fall onto the sheet 3, causing print quality of images to be deteriorated. On the other hand, in the mist collection component A, the step G is also formed between the end 14A of the partition 14 and the inlet end portion of the suction ports 10 (1) and 10 (2). Consequently, the mist having migrated to the inlet end portion of the suction ports 10 (1) and 10 (2) is unlikely to impact the end 14A of the partition 14. Thus, the mist is unlikely to adhere to the end 17A, allowing print quality of images to be restrained from being deteriorated as a result of possible fall of mist onto the sheet.

As described above, the mist collection component A in the present embodiment allows flows of the gas blown out through the blowout ports to uniformly arrive on the sheet. This allows development of a collection mechanism in which the mist is collected by being raised from above the sheet by the gas all over the print width of the sheet. Thus, the mist can be more reliably collected. Moreover, the mist can be made unlikely to adhere to the coupling portion between the suction ports. As a result, the mist can be restrained from flowing toward the downstream side in the conveying direction of the sheet, allowing avoidance of contamination of a pinch roller and the inside of a housing in the print apparatus. Furthermore, the print quality can be restrained from being deteriorated.

In the present embodiment, the mist collection component 2 is configured by coupling the two mist collection units 7(1) and 7(2) together. However, the number of mist collection units coupled together can be varied as needed according to the print width of images and the form of the print apparatus.

(Second Embodiment)

To reliably develop the collection mechanism in which the mist is collected by being raised from above the sheet as described above, flows of gas blown out through the adjacent gas blowout ports need to join each other before reaching the sheet. Through experiments and simulations, the inventors have found conditions under which the flows of the gas blown out through the adjacent gas blowout ports join each other.

Figure 7A:
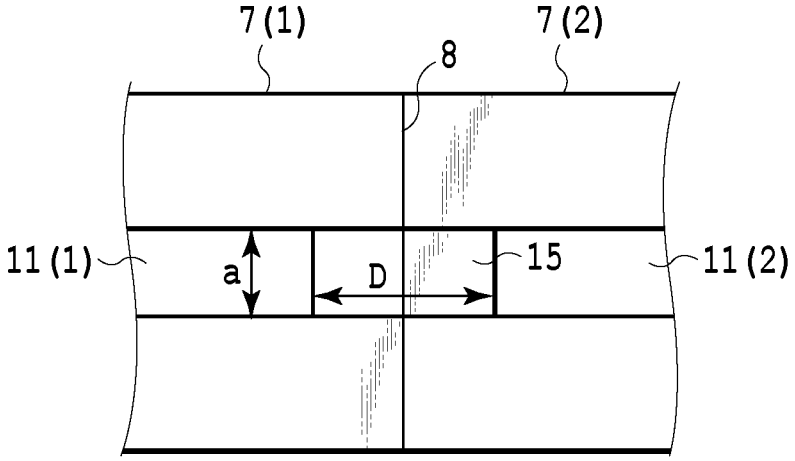
FIG. 7A is a bottom view of an important part of a mist collection component in a second embodiment of the present invention.
Figure 7B:
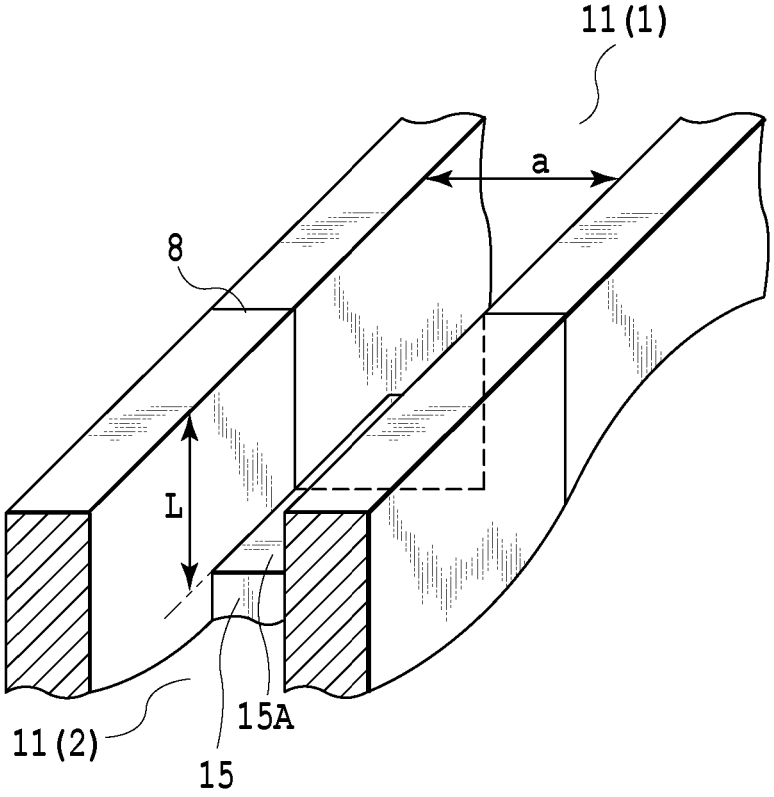
FIG. 7B is a perspective view of a blowout port portion in FIG. 7A.

FIG. 7A is a bottom view of the blowout ports 11 (1) and 11 (2) as seen from the sheet side. FIG. 7B is a perspective view of the blowout port portion in FIG. 7A. The width of the blowout port is denoted by a. The distance between the adjacent blowout ports (in the present embodiment, the distance is the same as a width W3 of the partition 15) is denoted by D. The average flow velocity of the gas blown out through the blowout ports is denoted by V. A distance (junction distance) over which the flows of the gas travel after the gas is blown out through the adjacent blowout ports and before the flows join together is denoted by t. These parameters have been found to have a relation expressed by Equation (1).

$$t=2\times V^{0.5}\times a^{0.4}\times D^{0.2} \qquad \text{Equation (1)}$$

Regardless of the distance between the outlet end portion of the blowout ports and the sheet, a withdrawn distance (step distance) L of the step G is set larger than the distance (t) to allow the flows of the gas blown out through the adjacent blowout ports to join together before arriving on the sheet. Then, the flows uniformly arrive on the sheet. The inventors have found that the above-described configuration allows the above-described mist collection mechanism to be developed. In other words, the withdrawn distance L of the step G may be $L\leq 2\times V^{0.5}\times a^{0.4}\times D^{0.2}$.

In the second embodiment, the mist collection component 2 is configured by coupling two mist collection units 7(1) and 7(2) each with a width of 10 inches together. As is the case with the first embodiment, the units 7 (1) and 7 (2) are coupled together so as to linearly arrange the blowout ports 11 (1) and 11 (2), and the step G is formed between the end 15A of the partition 15 and the outlet end portion of the blowout ports 11(1) and 11(2). Mist collection components C, D, and E are assumed in which the width a, the distance D, and the step distance L are set as follows.

Mist collection component C: the width a=1.0 mm, the distance D=3 mm, and the step distance L=2 mm Mist collection component D: the width a=2.5 mm, the distance D=3 mm, and the step distance L=2 mm Mist collection component E: the width a=2.0 mm, the distance D=2 mm, and the step distance L=4 mm Each of the mist collection components C, D, and E is mounted in the print apparatus as depicted in FIG. 1, and the collection rate for mist resulting from printing of images under the same conditions is estimated by simulation. The average flow velocity of the gas blown out through the blowout ports in this case is assumed to be 1 m/s. The results of the simulation are indicated in Table 2 below. The mist collection components D and E exhibit high mist collection rates, allowing substantially all of the mist to be collected. On the other hand, the mist collection component C exhibits a low mist collection rate and insufficiently collects the mist.

TABLE 2

Simulation results for second embodiment

| | Width a | Distance D | Step distance L | Junction distance t | Mist collection rate | Air current below coupling portion (8) |
|---|---|---|---|---|---|---|
| C | 1.0 mm | 3 mm | 2 mm | 2.5 mm | 30% | Fails to arrive on sheet |
| D | 2.5 mm | 3 mm | 4 mm | 3.6 mm | 95% | Arrives on sheet |
| E | 2.0 mm | 2 mm | 4 mm | 3.0 mm | 98% | Arrives on sheet |

In the mist collection component C, the junction distance t is longer than the step distance L. In the mist collection components D and E, the junction distance t is shorter than the step distance L. Thus, for the mist collection component C, the flows of the gas blown out through the adjacent blowout ports are expected to fail to join each other before reaching the sheet. The simulation results also indicate that the gas fails to arrive on the sheet, located below the coupling portion, leading to a low mist collection rate. For the mist collection components D and E, the flows of the gas blown out through the adjacent blowout ports are expected to successfully join each other before reaching the sheet. The simulation results also indicate that the flows of the gas uniformly arrive on the sheet, located below the coupling portion, leading to a high mist collection rate.

In the present embodiment, the step distance L is defined as the distance between the outlet end portions of the blowout ports 11 (1) and 11 (2) and the end 15A of the partition 15. Both an opening edge at the outlet end portions and the end 15A are planes parallel to the surface of the sheet. However, the opening edge at the outlet end portions and the end 15A may have any surface shapes. For example, at least one of the opening edges at the outlet end portions and the end 15A may be tapered or shaped like a bowl. Any surface shapes may be used so long as the step distance L and the junction distance t satisfy the above-described relation. The manner of coupling the adjacent blowout ports is not limited so long as the relation is satisfied. For example, the partition 15 may be configured exclusively for one of the adjacent blowout ports.

(Third Embodiment)

Figure 8:
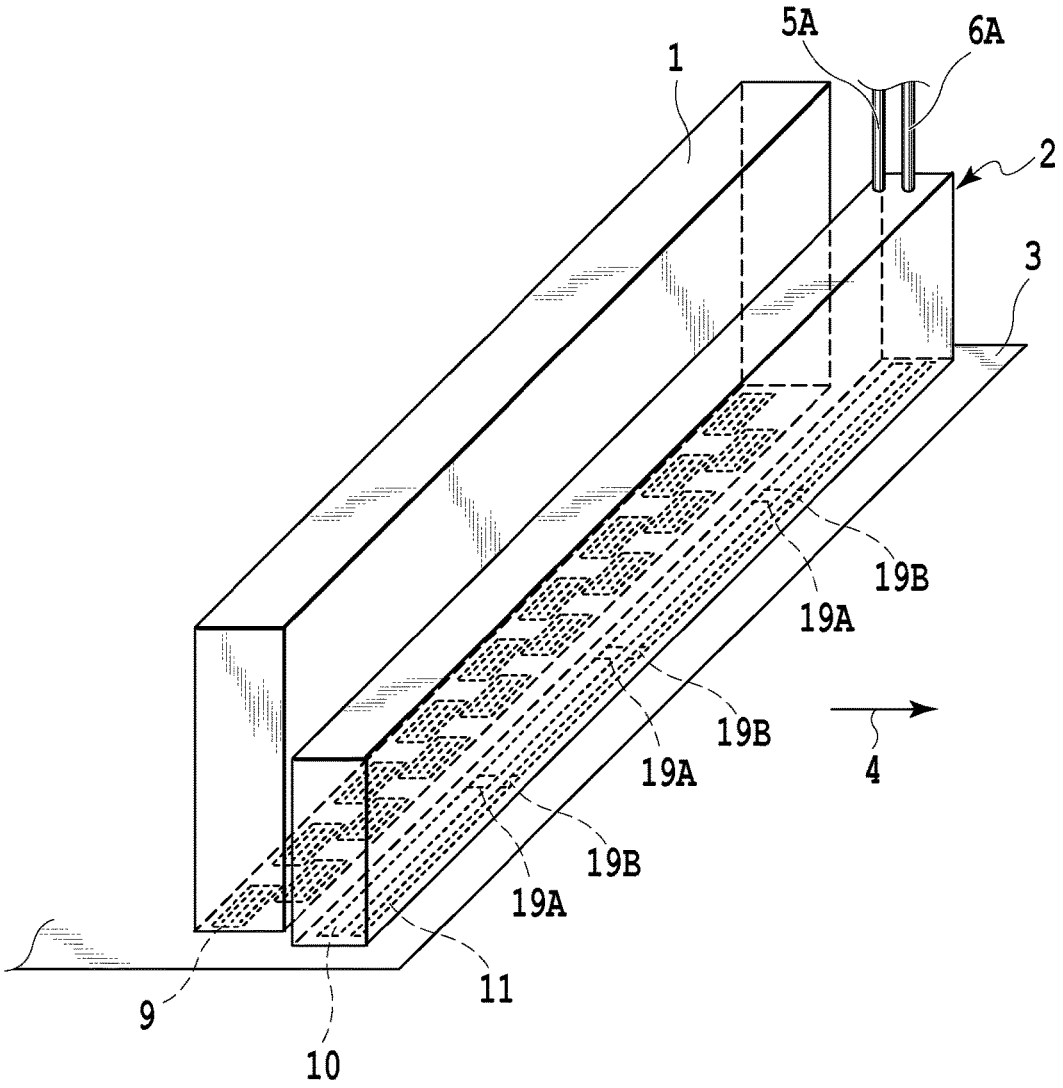
FIG. 8 is a perspective view of a mist collection component in a third embodiment of the present invention.

FIG. 8 is a schematic perspective view of the print head 1 and the mist collection component 2 in the present embodiment. One blowout port 11 and one suction port 10 for gas are formed in the mist collection component 2. Through the blowout port 11, gas is blown out which is fed from a gas supplying apparatus through the introduction pipe 6A located at a longitudinally first side of the mist collection component 2. The suction port 10 sucks the gas along with mist by suction force of a suction apparatus connected through the suction pipe 5A located at the longitudinally first side of the mist collection component 2.

Figure 9A:
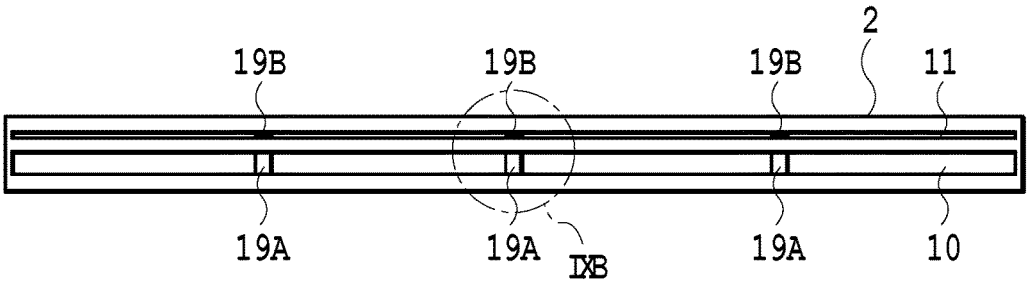
FIG. 9A is a bottom view of the mist collection component in FIG. 8.
Figure 9B:
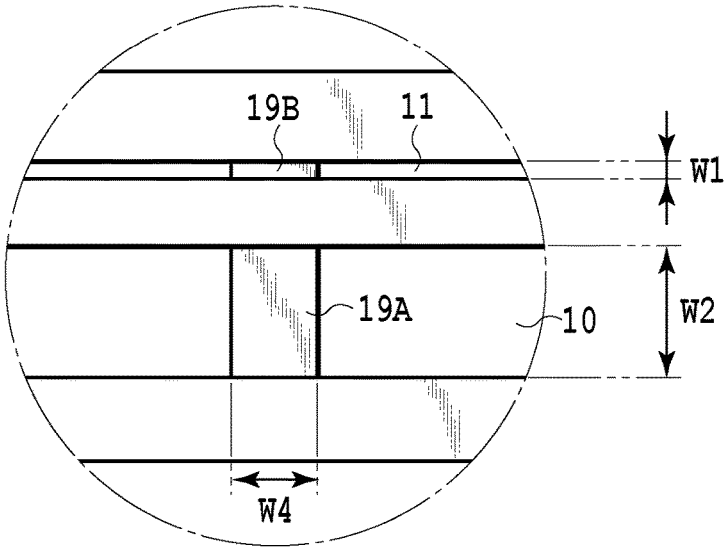
FIG. 9B is an enlarged view of an IXB circle portion in FIG. 9A.

FIG. 9A is a bottom view of the mist collection component 2 as seen from the sheet 3 side. FIG. 9B is an enlarged diagram of an IXB circle portion in FIG. 9A.

In the mist collection component 2 in the present embodiment, in association with a print width of 20 inches, the blowout port 11 and the suction port 10 are 20 inches in length, the width W1 of the blowout port 11 is 0.5 mm, and the width W2 of the suction port 10 is 3.0 mm. The blowout port 11 and the suction port 10 are each shaped like a slit having a uniform width except for the ends thereof.

For reinforcement for keeping the width of the suction port 10 in the long mist collection component 2 uniform, three partitions 19A that are beams each with a width W4 of 1 mm are provided at equal intervals. The partitions 19A divide the one suction port 10 into four suction port pieces that are adjacent to one another via the partitions 19A, which serve as opposite portions opposite to the sheet 3. Likewise, to keep the width of the blowout port 11 uniform, three partitions 19B each with a width W4 of 1 mm are provided at equal intervals. The partitions 19B divide the one blowout port 11 into four blowout port pieces that are adjacent to one another via the partition 19B, which serve as an opposite portion located opposite to the sheet 3. The partitions 19A and 19B are configured to allow the suction port 10 and the blowout port 11, which are shaped like slits, to have uniform widths. The number and width W4 of the partitions 19A and 19B provided may be varied according to the length and width of the suction port 10 and the blowout port 11.

Figure 10A:
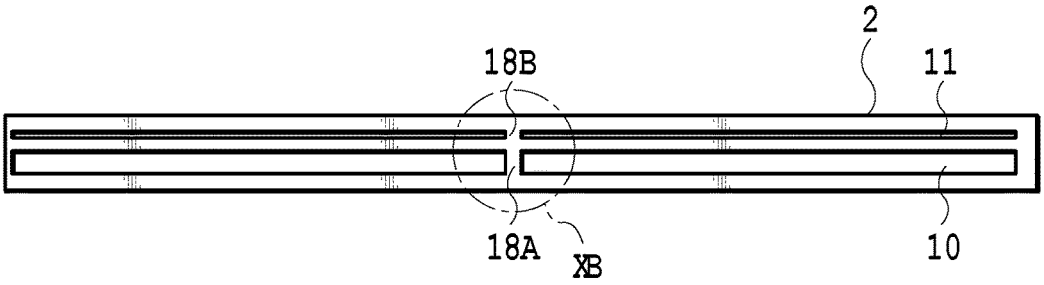
FIG. 10A is a bottom view of a mist collection component in a comparative example.
Figure 10B:
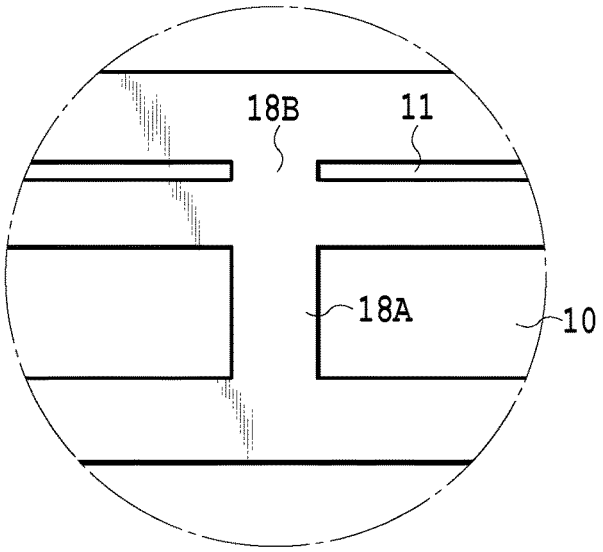
FIG. 10B is an enlarged view of an XB circle portion in FIG. 10A.

A step with a distance of 2 mm is provided between the inlet end portion of the suction port 10 and an end of each partition 19A located opposite to the sheet. Likewise, a step with a distance of 2 mm is provided between the outlet end portion of the blowout port 11 and an end of each partition 19B located opposite to the sheet. The mist collection component 2 with the stepped partitions 19A and 19B is referred to as the mist collection component F in the present embodiment. To confirm the effects of the mist collection component F in the present embodiment, a mist collection component G in a comparative example as depicted in FIG. 10A and FIG. 10B is assumed. In the mist collection component G, to keep the width of the suction port 10 uniform, one partition 18A with the same width as that of the partition 19A in the mist collection component F is provided. Likewise, to keep the width of the blowout port 11 uniform, one partition 18B with the same width as that of the partition 19B in the mist collection component F is provided. No step is formed between the inlet end portion of the suction port 10 and an end of the partition 18A located opposite to the sheet. Likewise, no step is formed between the outlet end portion of the blowout port 11 and an end of the partition 18B located opposite to the sheet. In this regard, the partitions 18A and 18B are different from the partitions 19A and 19B.

Each of the mist collection components F and G is mounted in the print apparatus as depicted in FIG. 1, and the collection rate for mist resulting from printing of images under the same conditions is estimated by simulation. The average flow velocity of the gas blown out through the blowout port in this case is assumed to be 1.0 m/s. The results of the simulation are indicated in Table 3 below. In the mist collection component F, the gas arrives on the sheet, located below the partition, resulting in a mist collection rate of 95%. Substantially all of the mist can be collected. On the other hand, in the mist collection component G, the gas fails to arrive on the sheet, located below the partition, precluding sufficient collection of mist.

TABLE 3

Simulation results for third embodiment

| Mist collection component | Partition step | Mist collection rate | Air current below partition |
|---|---|---|---|
| F | Step formed | 95% | Arrives on sheet |
| G | No step formed | 30% | Fails to arrive on sheet |

As described above, the mist collection component F in the present embodiment allows flows of the gas blown out through the blowout port to uniformly arrive on the sheet. This allows development of the collection mechanism in which the mist is collected by being raised from above the sheet by the gas all over the print width of the sheet. Thus, the mist can be more reliably collected. Moreover, the mist can be made unlikely to adhere to the partition. As a result, the mist can be restrained from flowing toward the downstream side in the conveying direction of the sheet, allowing avoidance of contamination of a pinch roller and the inside of a housing in the print apparatus. Furthermore, the print quality can be restrained from being deteriorated.

The mist collection component in the present embodiment is configured using a single unit with a partition. However, a plurality of units with partitions may be coupled together, and the partitions may be stepped.

(Fourth Embodiment)

In the present embodiment, the blowout port and the suction port for gas are configured using separate mechanisms, and the mechanisms are combined together to form a mist collection component.

Figure 11:
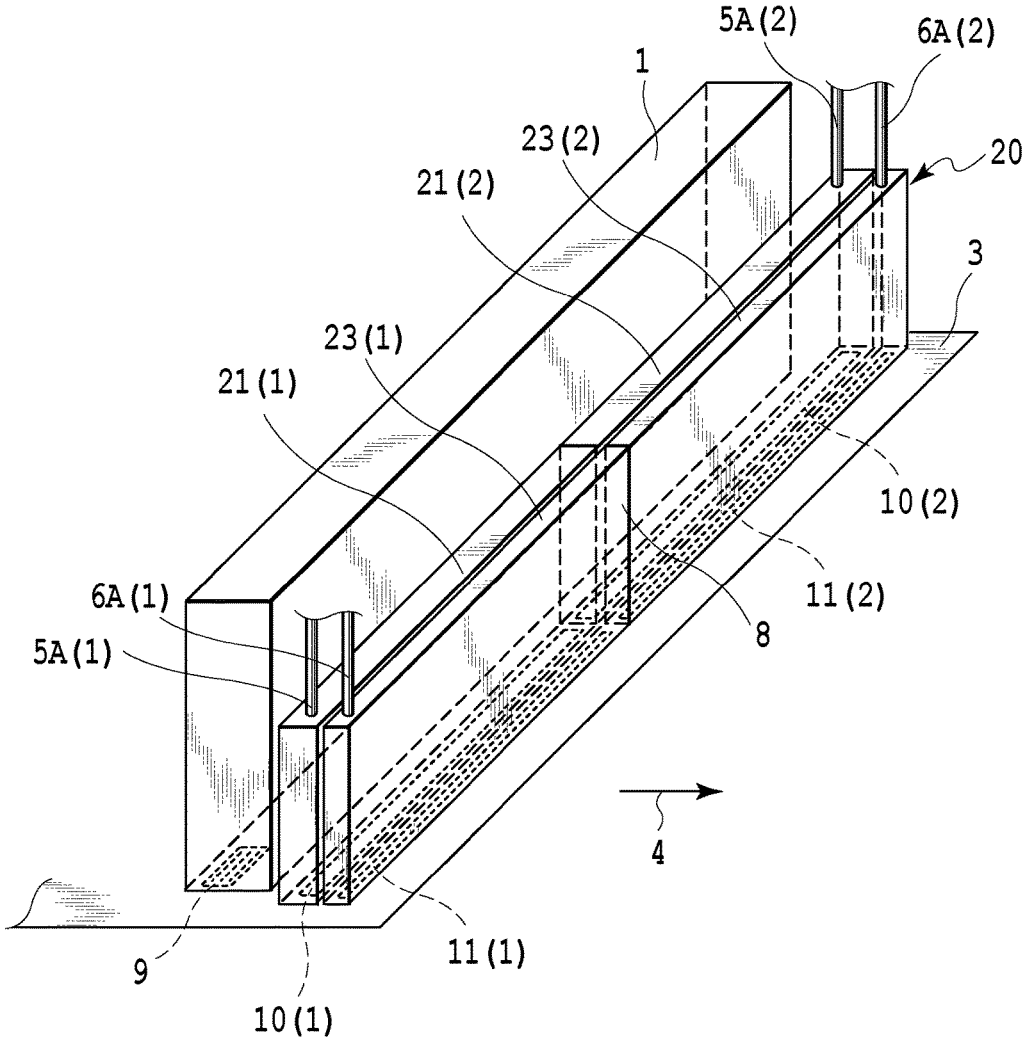
FIG. 11 is a perspective view of a mist collection component in a fourth embodiment of the present invention.

FIG. 11 is a schematic perspective view of the print head 1 and the mist collection component 20 in the present embodiment. The mist collection component 20 includes two blowout units 23 (1) and 23 (2) forming the blowout port and two suction units 21(1) and 21(2) forming the suction port. The blowout ports 11 (1) and 11 (2) are formed in each of the blowout units 23(1) and 23(2) and are connected to the gas supplying apparatus through the introduction pipes 6A (1) and 6A (2). The suction ports 10 (1) and 10 (2) are formed in each of the suction units 21(1) and 21(2) and are connected to the gas suction apparatus through the suction pipes 6A(1) and 6A (2).

Figure 12A:
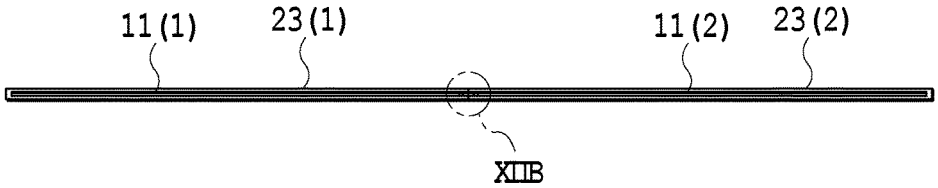
FIG. 12A is a bottom view of the mist collection component in FIG. 11.
Figure 12B:
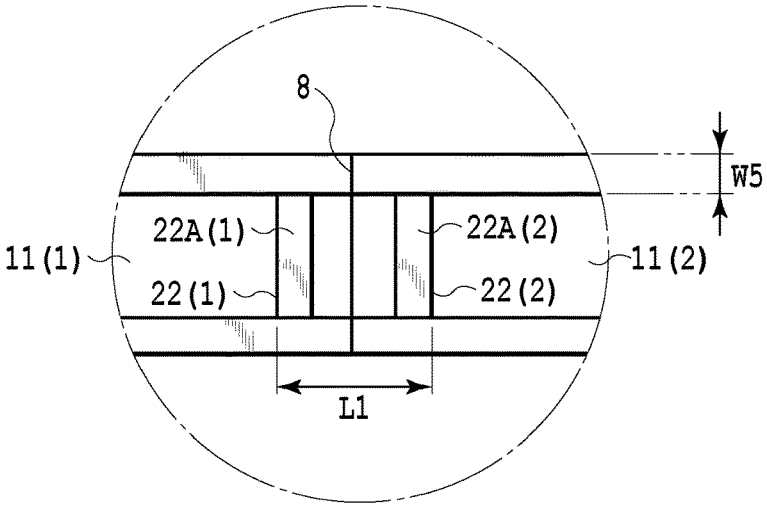
FIG. 12B is an enlarged view of an XIIB circle portion in FIG. 12A.
Figure 12C:
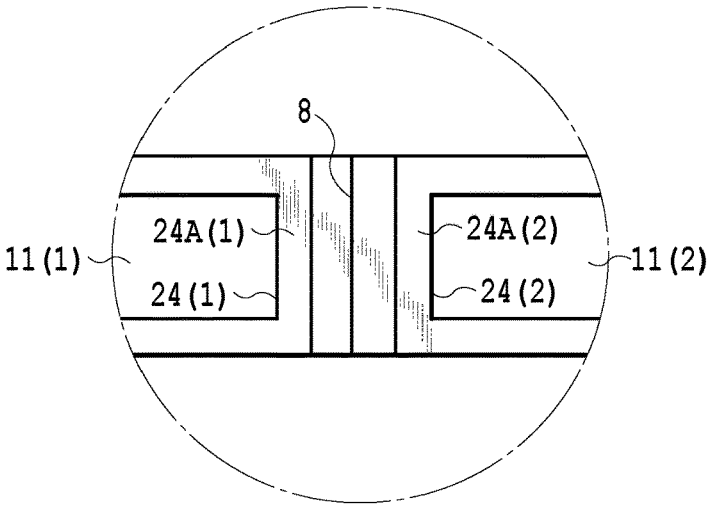
FIG. 12C is an enlarged view of an important part of a mist collection component in a comparative example.

FIG. 12A is a bottom view of the blowout units 23 (1) and 23 (2) as seen from the sheet 3 side. FIG. 12B is an enlarged diagram of an XIIB circle portion in FIG. 12A. In each of the blowout units 23 (1) and 23 (2), each of the blowout ports 11 (1) and 11 (2) is formed as a slit with a width of 1 mm and a length of 10 inches using a metal plate with a thickness W5 of 0.5 mm. The blowout units 23 (1) and 23 (2) are coupled together such that a partition 22 (1) forming a right end of the blowout port 11 (1) in FIG. 12A lies opposite to a partition 22 (2) forming a left end of the blowout port 11 (2) in FIG. 12A. The blowout ports 11 (1) and 11 (2) are aligned in a straight line with a distance L1 of 2 mm between the blowout ports 11(1) and 11(2). Ends 22A(1) and 22A(2) of the partitions 22(1) and 22(2) are displaced 3 mm from the outlet end portion of the blowout ports 11 (1) and 11 (2) toward the insides of the blowout ports 11 (1) and 11 (2) to form steps. A space or a coupling member may be present between the partitions 22 (1) and 22 (2). In either case, the position between the partitions 22 (1) and 22 (2) is displaced at least 3 mm from the outlet end portion of the blowout ports 11(1) and 11(2) toward the insides of the blowout ports 11(1) and 11(2). In other words, the blowout ports 11(1) and 11(2) are continuous with each other via the 3-mm step within the distance Ll. The mist collection component in which the blowout ports 11 (1) and 11 (2) are continuous with each other is referred to as the mist collection component H in the present embodiment H. To confirm the effects of the mist collection component H in the present embodiment, a mist collection component I in a comparative example as depicted in FIG. 12C is assumed. In the mist collection component I, ends 24A(1) and 24A(2) of partitions 24 (1) and 24 (2) forming the blowout ports 11 (1) and 11 (2) are located at the same height position as the outlet end portion of the blowout ports 11 (1) and 11(2), respectively, to form no step. Therefore, the blowout ports 11 (1) and 11 (2) are not continuous with each other.

Each of the mist collection components H and I is mounted in the print apparatus as depicted in FIG. 1, and the collection rate for mist resulting from printing of images under the same conditions is estimated by simulation. The average flow velocity of the gas blown out through the blowout ports in this case is assumed to be 1.0 m/s. The results of the simulation are indicated in Table 4 below. In the mist collection component H, the gas arrives on the sheet, located below the coupling portion 8, resulting in a mist collection rate of 95%. Substantially all of the mist can be collected. On the other hand, in the mist collection component I, the gas fails to arrive on the sheet, located below the coupling portion 8, preventing sufficient collection of mist.

TABLE 4

Simulation results for fourth embodiment

| Mist collection component | Continuity of blowout ports | Mist collection rate | Air current below coupling portion |
|---|---|---|---|
| H | Continuous blowout ports | 95% | Arrives on sheet |
| I | Discontinuous blowout ports | 30% | Fails to arrive on sheet |

As described above, the mist collection component F in the present embodiment allows flows of the gas blown out through the blowout port to uniformly arrive on the sheet. This allows development of the collection mechanism in which the mist is collected by being raised from above the sheet by the gas all over the print width of the sheet. Thus, the mist can be more reliably collected.

(Fifth Embodiment)

Figure 13:
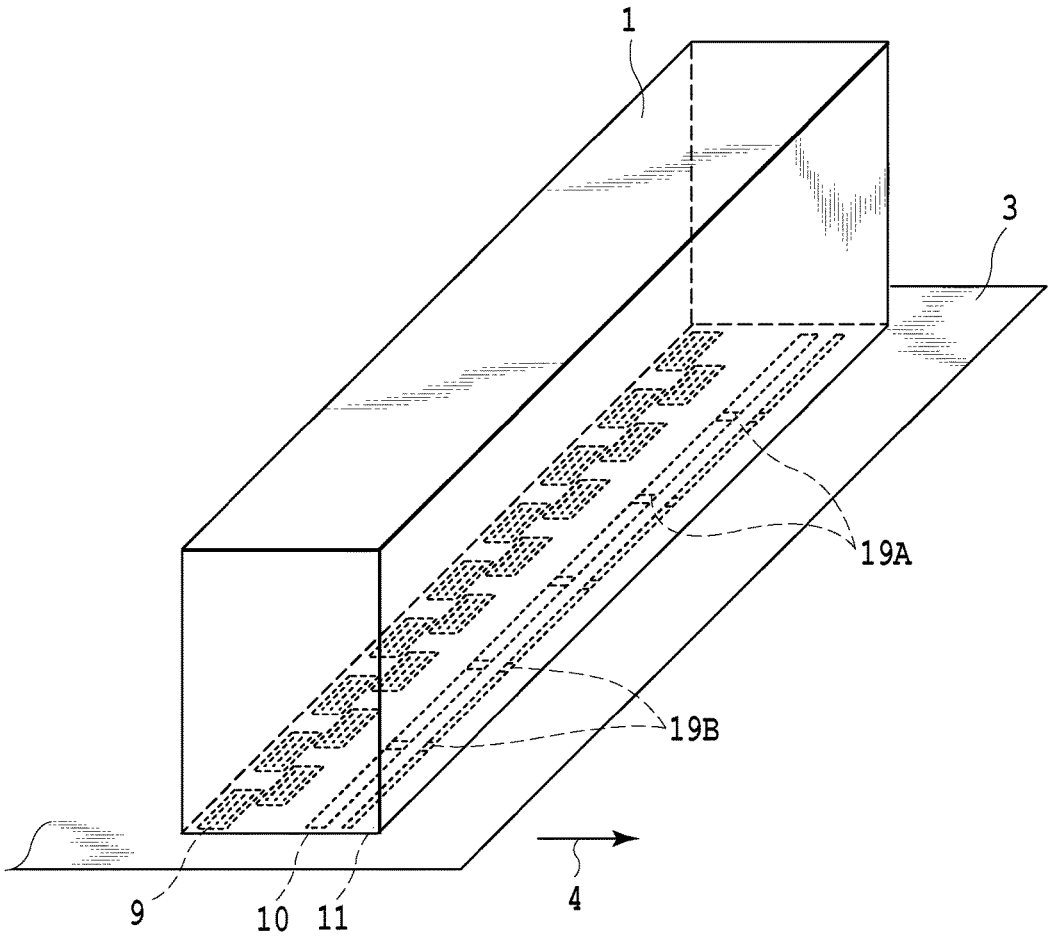
FIG. 13 is a perspective view of a mist collection component in a fifth embodiment of the present invention.

In the present embodiment, the mist collection component including the blowout port 11 and the suction port 10 for gas is integrated with the print head 1 as depicted in FIG. 13.

The blowout port 11 has a length of 20 inches in association with a print width of 20 inches and has a width of 0.5 mm. Thus, the blowout port 11 is shaped like a slit having a uniform width except for the ends thereof. To allow the long blowout port 11 as described above to have a uniform width, the blowout port 11 includes five partitions 19B provided at equal intervals and each having a width of 1.5 mm. The partitions 19B are configured to keep the width of the blowout port 11 uniform, and thus, the number and width of the partitions provided may be varied according to the length and width of the blowout port 11. An end of each of the partitions 19B is displaced 3 mm from the outlet end portion of the blowout port 11 toward the inside of the blowout port 11 to form a step between the end of the partition 19B and the opening of the blowout port 11. In the present example, the suction port 10 also includes five partitions 19A provided at equal intervals and each having a width of 1.5 mm. An end of each of the partitions 19A is displaced 3 mm from the inlet end portion of the suction port 10 toward the inside of the suction port 10. Consequently, a step is also formed between the end of the partition 19A and the opening of the suction port 10.

The mist collection component in which the partitions 19A and 19B are stepped and which is integrated with the print head is referred to as the mist collection component J in the present embodiment. To confirm the effects of the mist collection component J in the present embodiment, a mist collection component K in a comparative example is assumed in which at least the partitions 19B of the blowout port 11 are not stepped and which is integrated with the print head.

Each of the mist collection components J and K is mounted in the print apparatus as depicted in FIG. 1, and the collection rate for mist resulting from printing of images under the same conditions is estimated by simulation. The average flow velocity of the gas blown out through the blowout port in this case is assumed to be 1.0 m/s. The results of the simulation are indicated in Table 5 below. In the mist collection component J, the gas arrives on the sheet, located below the partitions, resulting in a mist collection rate of 95%. Substantially all of the mist can be collected. On the other hand, in the mist collection component K, the gas fails to arrive on the sheet, located below the partitions, preventing sufficient collection of mist.

TABLE 5

Simulation results for fifth embodiment

| Mist collection component | Partition step | Mist collection rate | Air current below partition |
|---|---|---|---|
| J | Step formed | 95% | Arrives on sheet |
| K | No step formed | 30% | Fails to arrive on sheet |

As described above, the mist collection component J in the present embodiment allows flows of the gas blown out through the blowout ports to uniformly arrive on the sheet. This allows development of the collection mechanism in which the mist is collected by being raised from above the sheet by the gas all over the print width of the sheet. Thus, the mist can be more reliably collected.

(Other Embodiments)

The present invention may also be applied as a mist collection apparatus configured to collect a mist of liquid ejected from various liquid ejection heads in printers and manufacturing apparatuses. Such a mist collection apparatus may be provided in various liquid ejection apparatuses. The blowout port and the suction port for gas may be provided for various liquid ejection heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-017080 filed Feb. 1, 2016, which is hereby incorporated by reference wherein in its entirety.

What is claimed is:

1. A liquid ejection apparatus comprising:

a conveyance unit configured to convey a sheet in a first direction;

a first print head provided with a plurality of ejection ports, arrayed along a second direction crossing the first direction, for ejecting a liquid toward the sheet;

a second print head arranged to be adjacent to the first print head on a downstream side of the first print head in the first direction and provided with a plurality of ejection ports, arrayed along the second direction, for ejecting a liquid toward the sheet;

a blow unit arranged between the first print head and the second print head in the first direction and configured to blow out a gas toward the sheet through a blowout port extending in the second direction, the blowout port being divided into a plurality of blowout ports by a partition, the partition being further away from the sheet than a part of the blowout port facing the sheet; and a suction unit arranged between the first print head and the blowout unit in the first direction and configured to suck an air through a suction port facing the sheet and extending in the second direction.

2. The liquid ejection apparatus according to claim 1, wherein the blowout port has a first blowout port and a second blowout port partitioned by a first partition.

3. The liquid ejection apparatus according to claim 2, wherein, in a case where a width of the first partition in the second direction is denoted by D, a width of each of the first blowout port and the second blowout port is denoted by a, and a blowout velocity of gas blown out through each of the first blowout port and the second blowout port is denoted by V, an end of the partition is positioned at a withdrawn position relative to outlet ends of the first blowout port and the second blowout port by a withdrawn distance L, such that $L \leq 2 \times V^{0.5} \times a^{0.4} \times D^{0.2}$.

4. The liquid ejection apparatus according to claim 2, wherein an end of the first partition is further away from the sheet than an opening tip of the blowout port in a direction crossing the sheet.

5. The liquid ejection apparatus according to claim 1, wherein the suction port has a first suction port and a second suction port partitioned by a second partition.

6. The liquid ejection apparatus according to claim 5, wherein an end of the second partition is further away from the sheet than an opening tip of the suction port in a direction crossing the sheet.

7. The liquid ejection apparatus according to claim 1, wherein each of the first and second heads is a line type inkjet head configured to eject an ink from the plurality of ejection ports to form an image on the sheet while the sheet is conveyed by the conveyance unit.

* * * * *